United States Patent [19]

Demuth et al.

[11] Patent Number: 4,528,722

[45] Date of Patent: Jul. 16, 1985

[54] CARD

[75] Inventors: Robert Demuth, Nürensdorf; Paul Staeheli, Wilen b. Wil, both of Switzerland

[73] Assignee: Rieter Machine Works Ltd., Winterthur, Switzerland

[21] Appl. No.: 588,809

[22] Filed: Mar. 9, 1984

[30] Foreign Application Priority Data

Mar. 21, 1983 [CH] Switzerland ..... 1525/83

[51] Int. Cl.[3] ..... D01G 15/12

[52] U.S. Cl. ..... 19/98; 19/103

[58] Field of Search ..... 19/98, 102, 103, 104, 19/110, 111

[56] References Cited

U.S. PATENT DOCUMENTS

| | | | |
|---|---|---|---|
| 451,367 | 4/1891 | Canning | 19/103 |
| 451,416 | 4/1891 | Canning et al. | 19/103 |

FOREIGN PATENT DOCUMENTS

| | | | |
|---|---|---|---|
| 948767 | 3/1956 | Fed. Rep. of Germany . | |
| 2400311 | 7/1975 | Fed. Rep. of Germany . | |
| 2440804 | 3/1976 | Fed. Rep. of Germany . | |
| 2834832 | 4/1979 | Fed. Rep. of Germany . | |
| 2406939 | 5/1979 | France . | |
| 6666 | of 1892 | United Kingdom | 19/103 |
| 1430784 | 4/1976 | United Kingdom . | |

*Primary Examiner*—Louis K. Rimrodt
*Assistant Examiner*—J. L. Kravitz
*Attorney, Agent, or Firm*—Werner W. Kleeman

[57] ABSTRACT

In a card, to avoid passage of fibers or fiber flocks over the edge of clothing into a gap, a covering band is pressed against an internal surface of the fiber-guiding roll or cylinder and a surface lying opposite the fiber-guiding roll. The covering band covers the gap between the fiber-guiding roll and a side wall portion. Two forwarding grooves, lying opposite one another in the gap and having transport surfaces lying opposite one another in crossed fashion, return fiber flocks which may possibly pass into the gap to the upper surface. A forwarding pin is set into the roll surface 7 of the fiber-guiding roll outside the edge of the clothing at such a inclination that fibers or fiber flocks which can pass into this region are transported by such pin towards pointed clothing of card flats.

12 Claims, 6 Drawing Figures

CARD

BACKGROUND OF THE INVENTION

The present invention relates to a new and improved construction of card which is of the type containing card flats as well as a rotating, fiber-guiding roll or cylinder which is provided with clothing, stationary side walls being situated opposite this fiber-guiding roll, and a gap is provided between each side wall and the fiber-guiding roll for ensuring for the free rotatability of such fiber-guiding roll.

In an apparatus of the type described above (e.g. as described in German published Patent Specification No. 2,834,832) a sealing band is removably secured to the side of the roll. This sealing band projects freely in an axial direction across the gap and overlaps the cylindrical surface of the roll without contact.

These measures do not, however, completely prevent fibers or fiber flocks collecting between the cylindrical surface of the roll and the overlapping sealing band, or that fibers or fiber flocks can pass through the gap into the zone within the roll and can be deposited at some arbitrary location. Depending upon the deposition location, such fiber or fiber flock deposits can be compressed between stationary and rotating elements and in dependence upon the degree of friction can be heated to an undesired extent.

SUMMARY OF THE INVENTION

Therefore, it is a primary object of the present invention to provide an improved construction of a card which is not afflicted with the aforementioned drawbacks and limitations of the prior art proposals.

It is a further more specific object of the present invention to provide an improved construction of a card in which fibers or fiber flocks which have collected at the edge of a roll provided with clothing do not pass into the gap, rather pass towards the card flats extending partially over the roll.

Another important object of the present invention is to provide a new and improved construction of a card which is relatively simple in construction and design, quite economical to manufacture, highly reliable in operation, not readily subject to breakdown or malfunction, and requires a minimum of maintenance and servicing.

Now in order to implement these and still further objects of the invention, which will become more readily apparent as the description proceeds, there is provided a card of the type described above, wherein at both axial end regions of the fiber-guiding roll or cylinder a respective internal surface constitutes the support or carrier for a related covering band which projects beyond the internal surface axially of the fiber-guiding roll, sealingly engages an internal surface of the opposing, stationary side wall and thus substantially covers the gap. Furthermore, at the end region of the roll, outside the clothing, means are provided which serve to forward or convey fibers passing into this region in a direction towards the card flats.

One of the notable advantages of the present invention is that, because the covering band is secured to the fiber-guiding roll, no friction heat must be taken up by such roll, instead this heat can be taken up by the side wall and transmitted without difficulty to the ambient air.

A further advantage is that the replacement or mounting of the covering band can be carried out without removal of the side walls; firstly, this is more favorable for maintenance purposes and, secondly, damage to the covering band during mounting or assembly is avoided.

The same advantage is also obtained for replacement of the forwarding or transporting pin which can be set or imbedded into the fiber-guiding roll in a region outside the card flats without dismantling the card.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
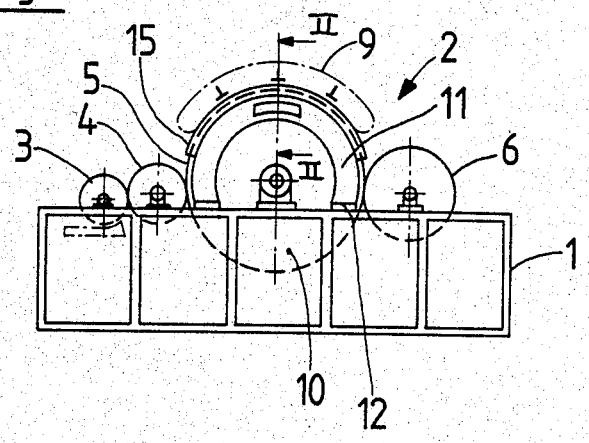
FIG. 1 schematically shows in side view a card constructed according to the present invention.

Describing now the drawings it is to be understood that in order to simplify the illustration thereof only enough of the construction of the card and its related structure has been shown as needed for those skilled in the art to readily understand the underlying principles and concepts of the present development. Turning attention now specifically to FIG. 1, it will be observed that the card 2 depicted therein has a feed roll 3, a taker-in roll or licker-in 4, a main fiber-guiding roll or cylinder 5 and a doffer roll 6 which are driveably and rotatably supported in any suitable manner in a frame 1 of the card 2. Above the fiber-guiding roll or cylinder 5, which is provided on its cylindrical surface 7 with clothing 8, there is arranged a set of card flats 9 with pointed elements or tips **9*a* (FIG. 2), so that fiber material (not shown) can be processed in known manner between the pointed elements 9*a* and the clothing 8**.

At each end face or surface 10 (FIG. 1) of the fiber-guiding roll or cylinder 5 an end or side wall 11 is provided which is secured by means of flanges 12 to the frame 1. Each end or side wall 11 extends with an end or side wall portion **11*a* to a position close to the substantially cylindrical surface 7 of the fiber-guiding roll 5 and to an end surface or face 13 (FIG. 5) of a related gap 14 having a width a which ensures for the free rotatability of the fiber-guiding roll or cylinder 5 relative to the side wall portion 11*a*, e.g. even with bearing-play of such fiber-guiding roll or cylinder. Between the end or side wall portion 11*a* and an end or side wall portion 11*b* extending substantially parallel thereto there is adjustably mounted a flexible curved portion 15 which is bent to a circular form and serves for precise guiding of the card flats 9 along the fiber-guiding roll or cylinder 5**.

Figure 2:
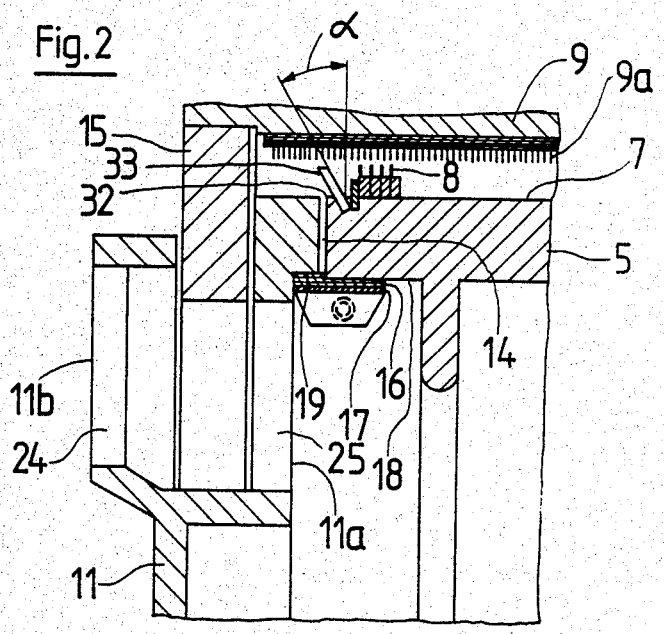
FIG. 2 shows a part of the card of FIG. 1, viewed in section taken substantially along the line II—II thereof.
Figure 4:
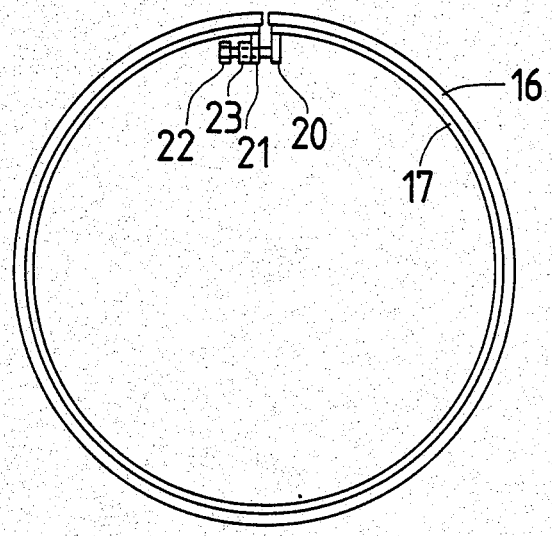
FIG. 4 shows a covering element or band used with the card in accordance with the invention.
Figure 5:
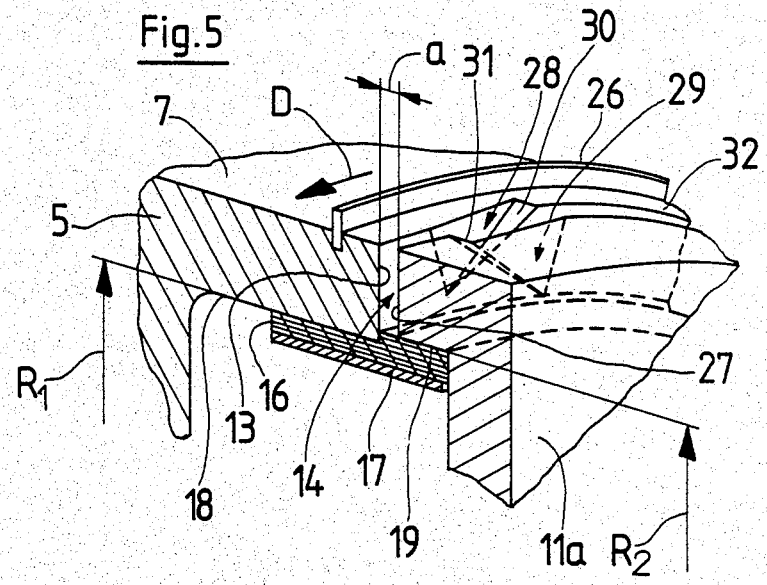

A textile covering band or element 16, e.g. a felt band, is provided for covering the gap 14. Band 16 is pressed by means of a circular clamping band or peripherally extendible spring band 17 (FIGS. 2, 4 and 5)

against an internal surface 18 of the fiber-guiding roll or cylinder 5. Thus, the covering band or element 16 is firmly secured to the fiber-guiding roll or cylinder 5 at each related axial end region of such roll and which end region defines a carrier or support for the related covering band or element 16. This covering band 16 extends across its related gap 14 and engages an inner friction or rubbing surface 19 of the side wall portion 11*a*.

The contact pressure or pressing action of the covering band or element 16 against this friction or rubbing surface 19 is of variable magnitude in dependence upon the difference ΔR between the two radii R1 and R2 (FIG. 5) and in dependence upon the elasticity of the covering band 16. The difference ΔR and the elasticity of the covering band material is so chosen that upon rotation of the fiber-guiding roll or cylinder 5 a sliding seal is produced without substantial heating.

In order that the clamping band 17 is able to perform its clamping function, joining or connection straps 20 and 21 (FIG. 4) are secured to respective band ends. Strap 20 will be conveniently called the pressure strap and strap 21 will be conveniently called the threaded strap. The threaded strap 21 has a screw-threaded bore (not shown) to receive a threaded bolt or screw 22. A nut 23 secures this threaded bolt 22 in the screw-threaded bore.

Assembly or mounting of the covering band or element 16 together with the clamping band or spring band 17 is achieved by pushing the opened covering band, with one end leading, through an assembly or mounting opening 24 and 25 in the wall portions 11*b* and 11*a*, respectively, until the complete covering band 16 can be laid on the aforesaid surfaces 18 and 19. Thereafter, the covering band 16 is pressed against these surfaces 18 and 19 by appropriate rotation of the threaded bolt 22.

The covering band 16 or equivalent covering element substantially prevents flow of air through the related gap 14, and thus constitutes a means to prevent as far as possible passage of fibers or fiber flocks which are transported or forwarded over the edge 26 of the clothing 8 into the gap 14.

A guide groove 28 is provided in the end face or surface 13 of the fiber-guiding roll 5 and a guide groove 29 is provided in the end face or surface 27 of the confronting end wall portion 11*a* situated opposite the end face 13 in order to pass back to the upper surface fiber flocks which may have gained access to the gap 14 in spite of the above-mentioned measures. Transport surfaces 30 and 31 associated with the grooves 28 and 29, respectively, are crossed in such a manner and, by reason of the small gap width a of approximately 1 mm, lie so closely opposite one another, that upon rotation of the fiber-guiding roll or cylinder 5 fiber flocks are transported back to the upper surface by the scissors-like effect of these two crossing transporting surfaces 30 and 31.

According to the invention a further means serves for forwarding or transporting of the fiber flocks towards the pointed elements or tips 9*a* of the card flats 9.

Figure 3:
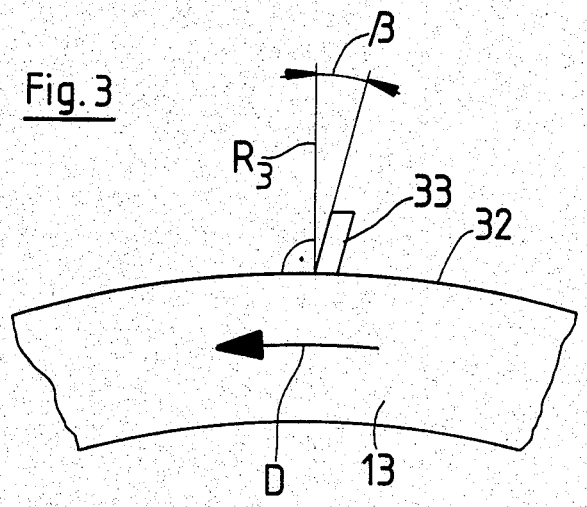
FIG. 3 shows a part of a fiber-guiding roll or cylinder of a card.

This forwarding or transporting means comprises at least one forwarding or transporting pin 33 (FIGS. 2 and 3) set or imbedded into the upper surface 32 extending between the end face or surface 13 and the edge 26 of the clothing 8. In order to optimize the fiber forwarding or transporting effect, the forwarding or transporting pin 33 is set into the fiber-guiding roll or cylinder 5 so as to be inclined, as viewed in the axial direction of such fiber-guiding roll or cylinder, at an angle α (FIG. 2) of approximately 30° towards the side wall 11 and, as viewed in the direction of rotation D of the fiber-guiding roll or cylinder 5, at an angle β (FIG. 3) of approximately 3° measured from a radius R3.

All of the afore-described three measures or facilities are provided on both sides or ends of the fiber-guiding roll or cylinder 5 at the respective axial end regions thereof.

Figure 6:
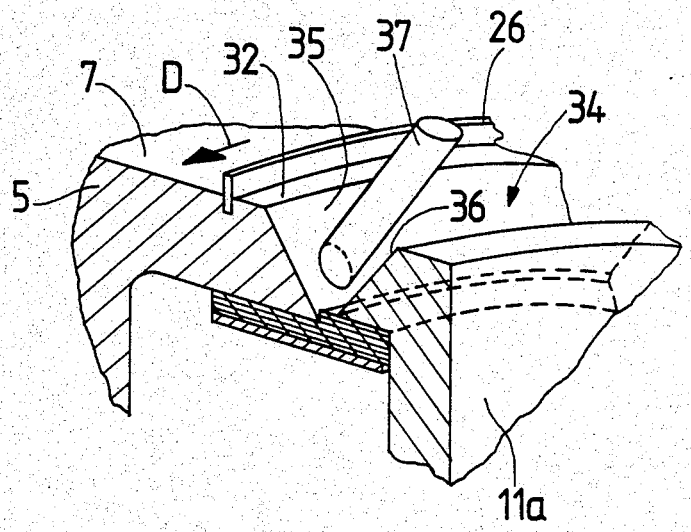
FIGS. 5 and 6 respectively show details of two parts of the card with covering elements or bands constructed according to the invention.

In a modification as shown in FIG. 6, a gap 34 (replacing the gap 14) opening in radial direction is formed between an inclined end face or surface 35 provided on the fiber-guiding roll or cylinder 5 and an end face or surface 36 which is also inclined and is provided on the related confronting side wall portion 11*a*. A forwarding or transporting pin 37 is set or imbedded at an inclination in the end face or surface 35 such that this pin 37 is arranged at the same inclination in relation to the fiber-guiding roll 5 as the previously described forwarding or transporting pin 33.

Furthermore, the forwarding or transporting pin 37 is arranged close to the covering band or element 16 approximately in the relationship illustrated in FIG. 6.

The modification illustrated in FIG. 6 is also provided on both sides or axial end regions of the fiber-guiding roll 5.

The forwarding pin or transporting 33 or 37 can be replaced or assembled or mounted in the region outside the card flats 9 without removal of the corresponding side or end wall 11, i.e., without dismantling of the card 2.

While there are shown and described present preferred embodiments of the invention, it is to be distinctly understood that the invention is not limited thereto, but may be otherwise variously embodied and practiced within the scope of the following claims.

Accordingly, what we claim is:

1. A card comprising:

card flats;

a rotatable fiber-guiding roll cooperating with said card flats;

clothing provided for said fiber-guiding roll;

stationary side walls located opposite opposed ends of said fiber-guiding roll;

each stationary side wall cooperating with said fiber-guiding roll so as to form therebetween a gap ensuring for the free rotatability of the fiber-guiding roll;

each stationary side wall having an inner friction surface;

said fiber-guiding roll defining at said opposed ends thereof a respective axial end region providing a carrier for a related covering band;

a respective covering band provided for each axial end region of said fiber-guiding roll;

each said covering band projecting beyond an internal surface of the fiber-guiding roll in axial direction of said fiber-guiding roll and sealingly engaging said inner friction surface of the stationary side wall lying opposite thereto, to thereby substantially cover the gap; and means provided in the axial end regions of the fiber-guiding roll outside the clothing for forwarding fibers passing into said axial end regions in a direction towards the card flats.

2. The card as defined in claim 1, further including:

a respective substantially circular, peripherally extendible spring band for pressing each covering band against the internal surface of the fiber-guiding roll.

3. The card as defined in claim 1, wherein:

said forwarding means comprises at each axial end region of the fiber-guiding roll a pair of forwarding grooves provided in the walls bounding the corresponding gap;

each of said pair of forwarding grooves having a transporting surface; and the transporting surfaces lying opposite one another in such a scissors-like fashion that fibers or fiber flocks are transported out of the gap upon rotation of the fiber-guiding roll by said transporting surfaces lying opposite to one another in said scissors-like fashion.

4. The card as defined in claim 1, wherein:

said fiber-guiding roll has an outer substantially cylindrical surface neighboring each gap;

said forwarding means comprising at each axial end region of the fiber-guiding roll a transporting pin which is set into said outer cylindrical surface of the fiber-guiding roll bounding the gap; and each said transporting pin having a free end projecting towards the card flats.

5. The card as defined in claim 4, wherein:

said fiber-guiding roll has a predetermined rotational direction;

each said transporting pin is arranged at an inclination with respect to said outer cylindrical surface towards the gap, as viewed in the axial direction of the fiber-guiding roll; and each said transporting pin being inclined rearwardly as viewed in said rotational direction of the fiber-guiding roll.

6. The card as defined in claim 1, wherein:

each said gap opens in radial direction;

said forwarding means comprises at each axial end region of the fiber-guiding roll a forwarding pin which, at the region of said gap opening in said radial direction, is set into a correspondingly inclined end face of the fiber-guiding roll; and each said forwarding pin having a free end projecting towards the card flats.

7. The card as defined in claim 6, wherein:

said fiber-guiding roll has a predetermined rotational direction;

each said forwarding pin is arranged at an inclination with respect to an outer cylindrical surface of the fiber-guiding roll towards its associated gap, as viewed in the axial direction of the fiber-guiding roll; and each said forwarding pin being inclined rearwardly as viewed in said rotational direction of the fiber-guiding roll.

8. The card as defined in claim 6, wherein:

the inclination of each forwarding pin as viewed in axial direction of the fiber-guiding roll encloses an angle of approximately 30° and as viewed in a predetermined rotational direction of the fiber-guiding roll encloses an angle of approximately 3°.

9. The card as defined in claim 2, wherein:

said forwarding means comprises at each axial end region of the fiber-guiding roll a pair of forwarding grooves provided in walls bounding the corresponding gap;

each of said pair of forwarding grooves having a transporting surface;

the transporting surfaces lying opposite one another in such a scissors-like fashion that fibers or fiber flocks are transported out of the gap upon rotation of the fiber-guiding roll by said transporting surfaces lying opposite to one another in said scissors-like fashion; and each side wall is provided in the region of the covering band with a respective assembly opening for replacement of such covering band.

10. The card as defined in claim 1, wherein:

said card flats are provided with pointed elements; and said forwarding means provided in the axial end regions of the fiber-guiding roll outside the clothing forwarding fibers passing into said axial end regions in a direction towards the pointed elements of the card flats.

11. The card as defined in claim 1, wherein:

said card flats protrude beyond the clothing provided for said fiber-guiding roll in the axial end regions of said fiber-guiding roll.

12. The card as defined in claim 1, wherein:

said forwarding means extend at an outward inclination and terminate above and axially beyond said gap formed between each stationary side wall and the fiber-guiding roll.

* * * * *